United States Patent [19]

Jarrell

[11] Patent Number: 4,841,704

[45] Date of Patent: Jun. 27, 1989

[54] SCREED TRACK FOR CONCRETE SLAB CONSTRUCTION

[76] Inventor: Stephen E. Jarrell, 8501 Southfield Pl., Raleigh, N.C. 27615

[21] Appl. No.: 197,645

[22] Filed: May 23, 1988

[51] Int. Cl.[4] ..... E04B 01/68; E01C 11/04

[52] U.S. Cl. ..... 52/396; 404/48; 404/64

[58] Field of Search ..... 52/396, 391, 403; 404/47–49, 64–68

[56] References Cited

U.S. PATENT DOCUMENTS

| | | | |
|---|---|---|---|
| 3,411,260 | 11/1968 | Dill | 52/396 X |
| 3,849,958 | 11/1974 | Balzer et al. | 52/396 |
| 3,871,787 | 3/1975 | Stegmeier | 404/48 |
| 3,896,597 | 7/1975 | Deason | 404/64 X |
| 4,329,080 | 5/1982 | Elley | 404/74 |
| 4,346,542 | 8/1982 | Tateno | 404/48 X |
| 4,548,009 | 10/1985 | Dahowski | 52/396 |

FOREIGN PATENT DOCUMENTS

| | | | |
|---|---|---|---|
| 10883 | 5/1980 | European Pat. Off. | 52/396 |
| 3503395 | 8/1986 | Fed. Rep. of Germany | 52/396 |
| 1309406 | 10/1962 | France | 52/396 |

*Primary Examiner*—J. Karl Bell

*Attorney, Agent, or Firm*—Rhodes, Coats & Bennett

[57] ABSTRACT

A unitary extruded, plastic screed track is disclosed for use in connection with concrete slab construction. The screed track includes two elongated, parallel side members disposed in substantially vertical planes in close, spaced-apart relationship. An interconnecting member extends between the spaced apart side members at a point intermediate the top and bottom edges of the side members so as to form an H-shaped cross section. An elongated, bonding member projects outwardly from not more than one of the side members for anchoring the screed track to the concrete slab which is cast in place on one side of the screed track. A pair of oppositely extending flanges project outwardly from the lower edge of respective side members for transferring load between the concrete slabs cast in place on opposite sides of the screed rail.

16 Claims, 2 Drawing Sheets

SCREED TRACK FOR CONCRETE SLAB CONSTRUCTION

FIELD OF THE INVENTION

The present invention relates generally to concrete slab construction, and more specifically to a leave-in-place screed track assembly forming a natural control joint for a concrete slab.

BACKGROUND OF THE INVENTION

In concrete slab construction, concrete slabs are cast in place on an underlying support structure. The concrete slabs, particularly in outdoor environments, are subject to thermal expansion and contraction which causes random cracks to form in the concrete. Cracks may also form as a result of movement of the underlying support structure, such as by settling. It is well known, that cracking can be minimized by use of control joints which divide the concrete slab into a number of separate sections.

One method of forming a control joint comprises using a saw to cut a joint into the concrete slab once the concrete has had sufficient time to set. A major drawback with the saw cutting method is that it increases labor costs since the workmen must return to the site to cut the joints a day after the concrete has been poured.

Another method of forming a control joint comprises placing metal or concrete joints on the underlying support structure before pouring the concrete slab. The concrete is then poured in place on both sides of the joint so that the top of the slab is even with the top of the metal or concrete joint. However, most joints do not provide a screeding surface which is helpful in obtaining a flat, level slab of uniform thickness. Those joints which do provide a screeding surface are generally made of concrete. Such joints are extremely heavy and are difficult to transport and handle.

SUMMARY AND OBJECTS OF THE INVENTION

The leave-in-place screed track of the present invention overcomes these and other problems associated with the prior art joints. The leave-in-place screed track is a unitary construction comprising two elongated, parallel side members disposed in substantially vertical planes and a horizontally disposed interconnecting portion joining the side members. The outer surface of one side member is substantially flat so as to form a natural control joint. An elongated, bonding strip projects outwardly from the opposite side member to anchor the screed track to the concrete slab. Two oppositely extending flanges extend outwardly from the bottom edges of the side members to maximize slow transfer. The upper edges of the side members provide a screeding surface for guiding a vibratory screed.

Accordingly, it is an object of the present invention to provide a joint capable of preventing cracks from occurring in a concrete floor.

Another object of the present invention is to provide a joint that is relatively lightweight and which can be easily handled at the construction site.

Another object of the present invention is to provide a joint which maximizes load transfer between adjacent concrete slabs.

Still another object of the present invention is to provide a joint for concrete slab construction having an integral screeding surface.

Another object of the present invention is to provide a joint which bonds to the slab on one side providing a natural control joint.

Another object of the present invention is to provide a joint which minimizes installation and labor time.

Another object of the present invention is to provide a joint that is easily adaptable to various types of underlying support structures.

Other objects and advantages of the present invention will become apparent and obvious from a study of the following description and the accompanying drawings which are merely illustrative of such invention.

DETAILED DESCRIPTION OF THE INVENTION

Figure 1:
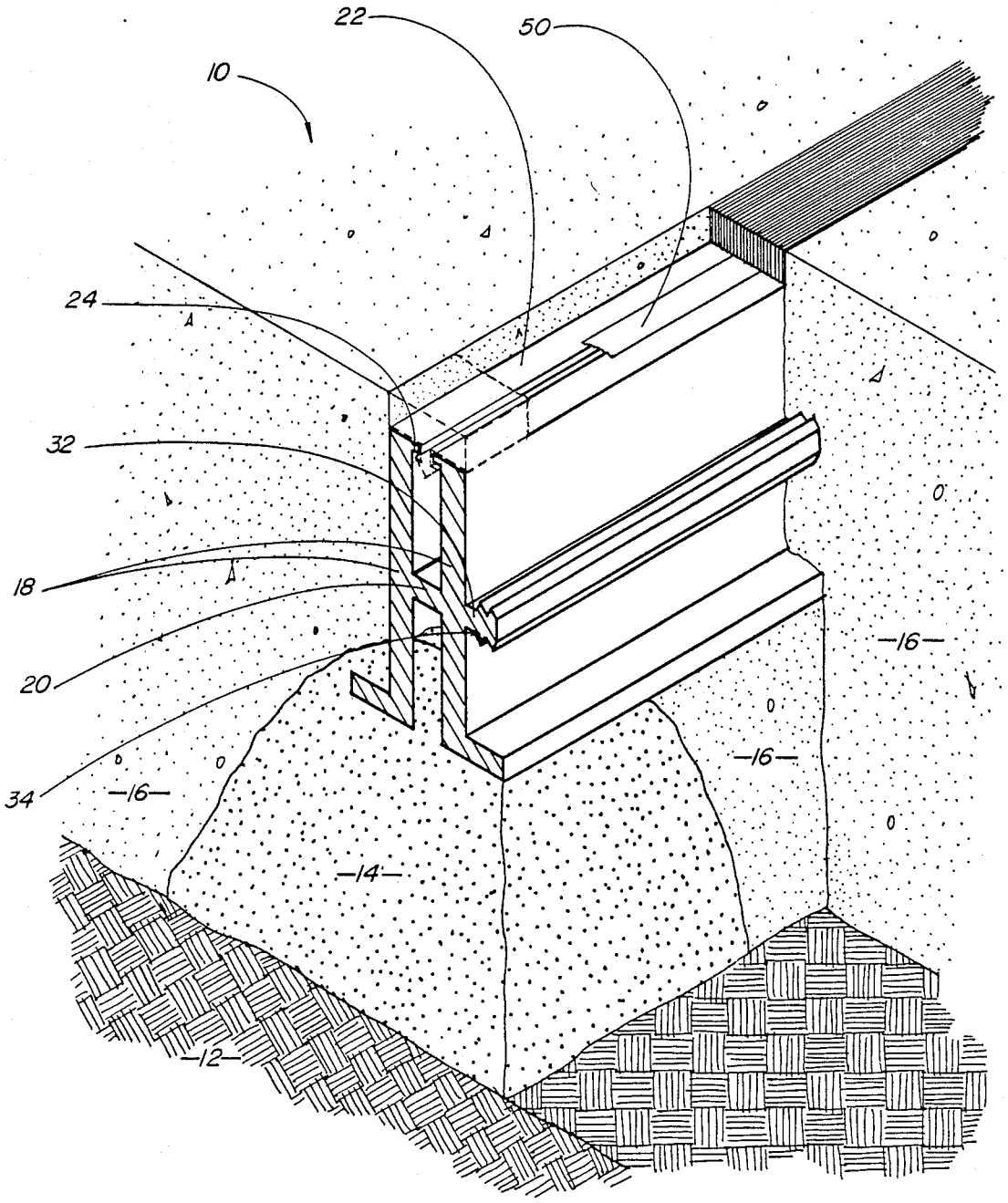
FIG. 1 is a perspective view of the screed track assembly of the present invention.
Figure 2:
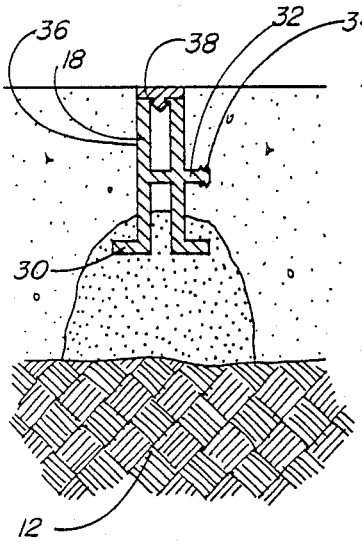
FIG. 2 is a section view of the screed track assembly including the end cap.
Figure 3:
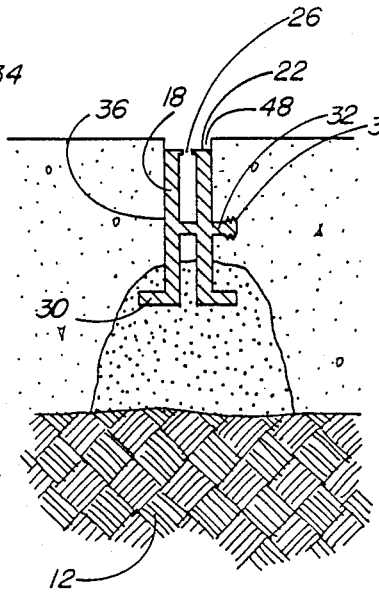
FIG. 3 is a section view of the screed track assembly showing the end cap removed.
Figure 4:
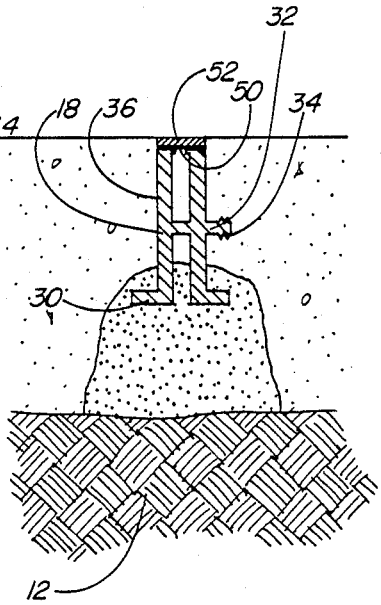
FIG. 4 is a section view of the screed track assembly showing a joint sealant replacing the end cap.

Referring now to the drawings, the screed track assembly of the present invention, generally designated 10, is shown therein. As shown in FIG. 1, the screed track 10 is used in connection with concrete slab construction where concrete slabs are formed in place on an underlying support structure 12. The support structure 12 may consist of ground or metal decking. As shown in FIG. 1, the screed track 10 is supported by a plurality of longitudinally spaced, concrete piles 14 into which the screed track 10 is partially embedded. Concrete slabs 16 are formed in place on the underlying support structure 12 on opposite sides of the screed track 10.

The screed track 10 is a unitary extrusion of PVC plastic or similar material. The screed track includes two vertically disposed side rails 18 which are joined by a horizontal interconnecting portion 20. As is apparent, the side rails 18 and interconnecting portion 20 form an H-shape.

The top edges of the side rails 18 have inwardly projecting tongues 24 which defines a narrow slot 26 extending the length of the screed track 10. A pair of outwardly extending flanges 30 project from the bottom edges 28 of the side rails 18. Flanges 30 maximize load transfer across the joint and prevent vertical displacement of one concrete slab 16 with respect to the other.

A longitudinal bonding member 32 projects outwardly from one of the side rails. The bonding member 32 includes a plurality of serrations 34 on its upper and lower surfaces which mechanically interlock with the concrete slab on one side of the screed track 10. The opposite side rail 18 has a substantially flat surface 36 which interfaces with the concrete slab 16. Because the concrete bonds to only one side, a natural control joint is provided.

The screed track 10 comes with an optional cap 38 which includes a downwardly projecting locking member 40. Locking member 40 is insertable into slot 26 formed between the top edges of side rails 22. Projections 42 formed in the locking member 40 engage the inwardly projecting tongues 24 formed in the side rails 22 to releasably secure cap 38 in place.

FIGS. 1 through 4 illustrate one of many different methods for using the screed track 10 of the present invention. As shown in FIG. 1, the underlying support structure 12 is the earth which is graded and prepared according to well-known construction techniques. The screed track 10 is then placed according to the engineer's specifications on the underlying support structure 12. This is done by forming longitudinally spaced concrete piles 14 into which the screed track 10 is partially embedded as clearly seen in FIG. 1. It is noted that the bottom edge of the screed track 10 is disposed above the underlying support structure 12 so that an open in space between the screed track 10 and support surface 12 is formed. When setting the screed track 10 into the concrete piles, caution should be exercised to assure that the top of cap 38 is level.

Concrete slabs 16 are poured in place on both sides of screed track 10, one slab at a time. Once the concrete slabs 16 are poured, the top of cap 38 can be used as a screeding surface to guide a vibratory screed or similar device for leveling the concrete slab 16. Thus, a flat slab 16 of uniform thickness can be obtained.

When the concrete slabs 16 have set, the cap 38 is removed leaving a void 48 in the space previously occupied by the cap 38. In actual practice, the width of the void should be approximately twice the depth of the void 48. A bond breaker tape 50 is then applied to the top edges 22 of the side rails 18. A joint sealant 52 is then poured into the void 48 on top of the bond breaker tape 50. The bond breaker tape 50 prevents the joint sealant from bonding with the side rails 18 so that the joint formed will expand and contract with the concrete slab 16. The joint sealant 52 prevents entry of water into the crack formed between the concrete slab 16 thus further minimizing the risk that the concrete slabs 16 will crack.

Figure 5:
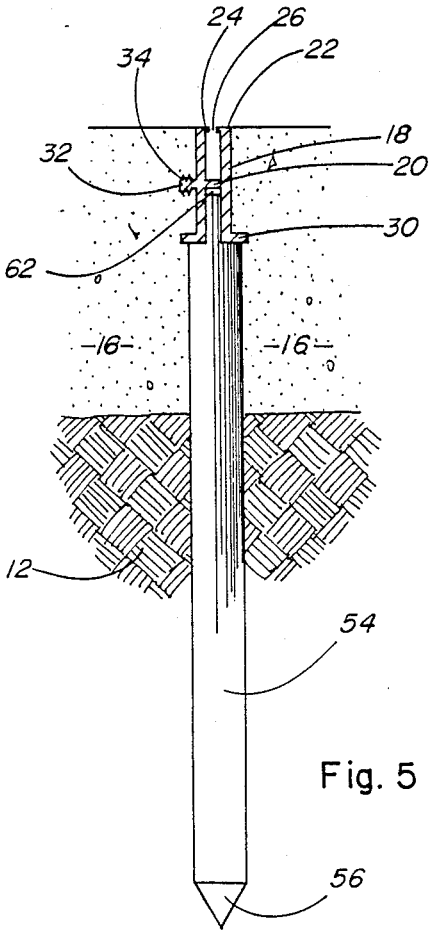
FIG. 5 is a section view of the screed track assembly supported from the underlying support structure by stakes.
Figure 6:
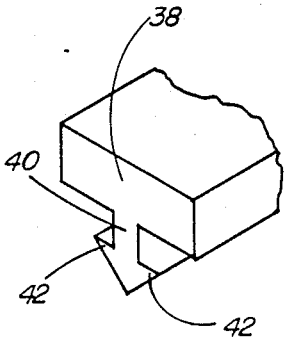
FIG. 6 is a perspective view of an end cap.
Figure 7:
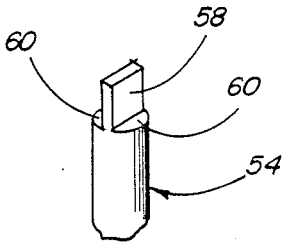
FIG. 7 is a perspective view of the upper end of a support stake.

In FIGS. 5 and 6, a second method for using the present invention is shown. In this embodiment, the screed track 10, which is identical to that previously described, is supported on support stakes 52 which are driven into the underlying support structure 12. The support stakes 54 include a lower pointed end 56 which facilitates penetration of the stake into the earth. The upper end of the stake 54 includes a tongue 58 having a pair of shoulders 60 formed on opposite sides thereof. Tongue 58 is insertable into the lower cavity 62 formed between the side rails 18 until the shoulders 60 engage the outwardly extending flanges 30. In the preferred embodiment, the support stakes 54 are also constructed of PVC or similar material and can be secured to the screed track 10 by a PVC type glue.

The use of the screed track 10 of the present invention with the support stake 16 is essentially the same as that described above. The support stakes 16 are longitudinally spaced along the line of the proposed control joint. Each stake 54 is turned so that the tongues 58 all align along the axis of the joint. The screed track 10 is then pressed over the tongues 54 on the upper end of the stakes 54 and secured by a PVC type glue. Once the screed track 10 is placed, the concrete slab 16 are poured on each side of the screed track as previously described.

In certain circumstances, the project engineer may elect to use the screed track 10 without the optional cap 38 as shown in FIG. 5. If such as election is made, the concrete slab 16 are poured until they are approximately level with the top edge of the side rails 18. The top edges 22 of the side rails 18 can then be used as a screeding surface to guide the vibratory screed for leveling the concrete slab 16.

The present invention eliminates many of the problems associated with prior art devices. It is extremely lightweight and easily handled at the construction site. Further, the screed track 10 of the present invention speeds up the construction process by providing a screeding surface to guide a vibratory screed.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A leave-in-place, screed track assembly for use in connection with concrete slabs poured in place on an underlying support surface, the screed track assembly comprising:

(a) a base structure extending upwardly from the underlying support surface; and (b) an integrated screed track interposed between two adjacent concrete slabs and supported by said base structure in a substantially horizontal position, the screed track including:

(1) two elongated, parallel side rails disposed in substantially vertical planes in close, spaced-apart relationship, each side rail including a top edge and a bottom edge;

(2) a generally horizontal, interconnecting member disposed between the spaced-apart, side rails for connecting the side rails;

(3) an elongated, bonding member projecting laterally from not more than one of the side rails for mechanically interlocking the screed track with the concrete slab on one side of the screed track, the opposite side rail being substantially flat so as not to mechanically interlock with the concrete slab; and (4) a pair of oppositely extending flanges projecting laterally from the bottom edges of respective side rails for maximizing load transfer between the concrete slabs on opposite sides of the screed track.

2. The leave-in-place, screed track assembly according to claim 1 wherein the interconnecting member extends between the side members at a point intermediate the top and bottom edges so as to form an H-shaped cross section.

3. The leave-in-place, screed track assembly according to claim 1 wherein the bonding member is disposed at a point intermediate the top and bottom edge of the side rails and extends parallel to the top and bottom edges.

4. The leave-in-place, screed track assembly according to claim 3 wherein the bonding member includes a plurality of longitudinally extending serrations.

5. The screed rail assembly according to claim 1 wherein the screed rail structure is constructed of a rigid, plastic material.

6. The screed track assembly according to claim 5 wherein the screed rail structure is constructed of polyvinylchloride.

7. The screed track assembly according to claim 1 wherein the base structure includes a plurality of support stakes disposed in longitudinal spaced-apart relationship, each said support stake including an upper end portion for engaging the screed track.

8. The leave-in-place, screed track assembly according to claim 7 wherein the upper end portion of the support stake includes a tongue portion receivable in the space between the side rails.

9. The leave-in-place, screed track assembly according to claim 8 wherein each support stake includes shoulder means disposed on opposite sides of said tongue portion for engaging the flanges on the screed track.

10. In a concrete slab construction including an underlying support surface and a pair of concrete slabs formed in place on said support surface, the improvement comprising a unitary plastic screed track interposed between the concrete slabs to provide a natural control joint, the screed track including: a pair of parallel side rails disposed in substantially vertical planes, each side rail including a bottom edge and a top edge; a pair of oppositely extending flanges projecting laterally from the bottom edges of respective side rails for maximizing load transfer between adjacent concrete slabs; a bonding member associated with not more than one of said side rails and disposed intermediate the top and bottom edges of said side rail for mechanically interlocking with the concrete slab on one side of said screed track, the opposite side rail being substantially flat so as not to mechanically interlock with the concrete slab; and an interconnecting portion disposed between said side rails for connecting said side rails.

11. The concrete slab construction according to claim 10 wherein the improvement further comprises a cap which interlocks with the top edges of the side rails and includes an upper screeding surface level with the top of said concrete slabs, said cap being removal from said screed track so as to form a void in the space previously occupied by said cap.

12. The concrete slab construction according to claim 11 wherein a pair of tongues project inwardly from the top edges of said side rail to form a narrow slot, and wherein said cap includes a downwardly projecting locking member insertable into said slot, said locking member including lateral projections for engaging the inwardly projecting tongues on said side rails.

13. In a concrete slab construction including an underlying support surface and a pair of concrete slabs formed in place on said support surface, the improvement comprising:

(a) a unitary, plastic screed track interposed between the concrete slabs to provide a natural control joint, the screed track including:
  (1) a pair of parallel side rails disposed in substantially vertical planes, each side rail including a bottom edge and a top edge;
  (2) a pair of oppositely extending flanges projecting laterally from the bottom edges of respective side rails for maximizing load transfer between adjacent concrete slabs;
  (3) a bonding member associated with not more than one of said side rails and disposed intermediate the top and bottom edges of said side rail for mechanically interlocking with the concrete slab on one side of said screed track, the opposite side rail being substantially flat so as not to mechanically interlock with the concrete slab; and
  (4) a generally horizontal, interconnecting portion disposed between said side rails intermediate the top and bottom edges thereof so as to divide the space between said side rails into an upper and lower cavity; and (b) a plurality of support stake disposed in longitudinal spaced-apart relationship, each said support stake including a lower end embedded in said underlying support surface and an upper end disposed above the underlying support surface for engaging and supporting said screed track.

14. The concrete slab construction according to claim 13 wherein the upper end of said support stakes include a tongue insertable into the lower cavity of said screed track.

15. The concrete slab construction according to claim 14 wherein the upper end of the support stakes include a pair of shoulders disposed on opposite sides of said tongue for engaging said laterally projecting flanges of said screed track.

16. The concrete slab construction according to claim 13 wherein the top edges of said side rails are even with the upper surface of said concrete slabs.

* * * * *